US009892905B2

(12) United States Patent
Jurkovic

(10) Patent No.: US 9,892,905 B2
(45) Date of Patent: Feb. 13, 2018

(54) STRANDED OUTER LEAD WIRE ASSEMBLY FOR QUARTZ PINCH SEALS

(71) Applicant: Eye Lighting International of North America, Inc., Mentor, OH (US)

(72) Inventor: Paul J. Jurkovic, Painesville, OH (US)

(73) Assignee: Eye Lighting International of North America, Inc., Mentor, OH (US)

( * ) Notice: Subject to any disclaimer, the term of this patent is extended or adjusted under 35 U.S.C. 154(b) by 0 days.

(21) Appl. No.: 15/369,884

(22) Filed: Dec. 5, 2016

(65) Prior Publication Data

US 2017/0162376 A1 Jun. 8, 2017

Related U.S. Application Data

(60) Provisional application No. 62/262,768, filed on Dec. 3, 2015.

(51) Int. Cl.
*H01J 61/36* (2006.01)
*H01J 9/28* (2006.01)

(52) U.S. Cl.
CPC ..... *H01J 61/368* (2013.01); *H01J 9/28* (2013.01)

(58) Field of Classification Search
CPC ..... H01J 61/368; H01J 9/28
See application file for complete search history.

(56) References Cited

U.S. PATENT DOCUMENTS 4,061,939 A * 12/1977 Strok, Jr. ..... H01J 61/366 313/25
5,962,960 A * 10/1999 Regitz ..... H01J 61/366 313/331
2005/0146257 A1* 7/2005 Trujillo ..... H01L 21/67115 313/17

* cited by examiner

*Primary Examiner* — Anne Hines
(74) *Attorney, Agent, or Firm* — Dwight A. Stauffer Patent Services

(57) ABSTRACT

A stranded outer lead wire assembly for a quartz pinch sealed lamp. The stranded outer lead wire assembly is a butt welded connection of a refractory metal outer pinch lead (e.g., molybdenum solid wire) and a stranded soft metal lead wire (e.g., nickel wire strands twisted together). The assembly is prefabricated and then welded to sealing foil to make a four part foliated lead wire assembly for pinch sealing in the quartz outer jacket. The foliated lead wire assembly and a quartz envelope lamp utilizing the stranded outer lead wire assembly are also claimed. The sealing machine is adapted to protect the stranded outer lead assembly with a water cooled sleeve. In an embodiment, the outer end of the stranded lead is fused to prevent fraying.

19 Claims, 5 Drawing Sheets

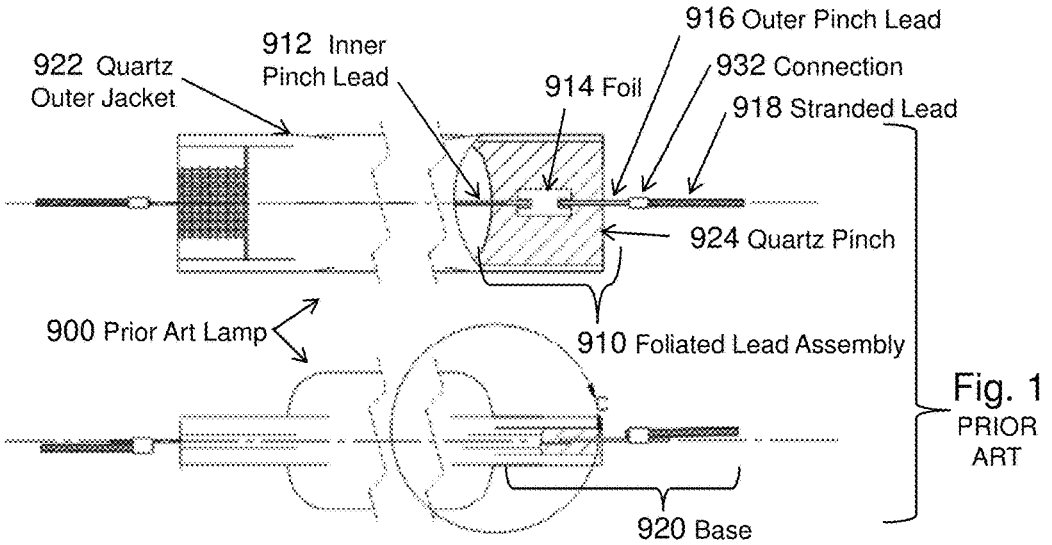
Fig. 1 PRIOR ART
PRIOR ART OUTER LEAD WITH CRIMP CONNECTION
Example: 1000 W DE Horticultural lamp
Fig. 1A PRIOR ART
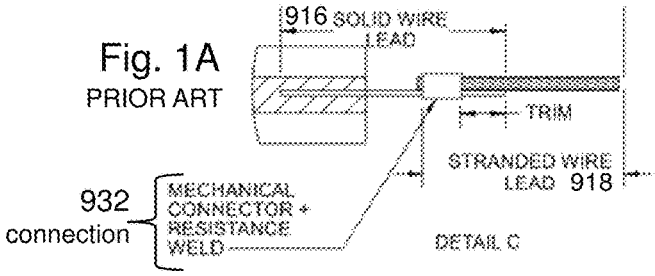
Fig. 2 PRIOR ART LAMP 900 EXAMPLE (IMAGE)
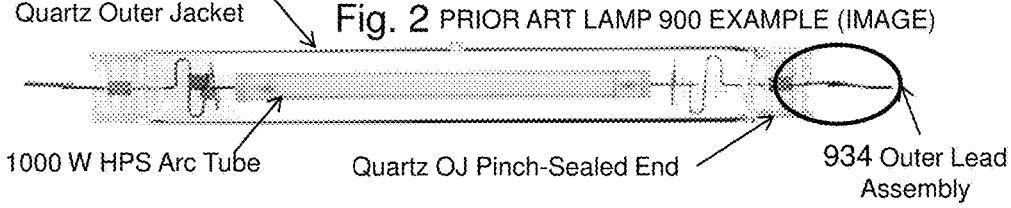
Fig. 3 PRIOR ART OUTER LEAD ASSEMBLY 934 EXAMPLES (IMAGES)
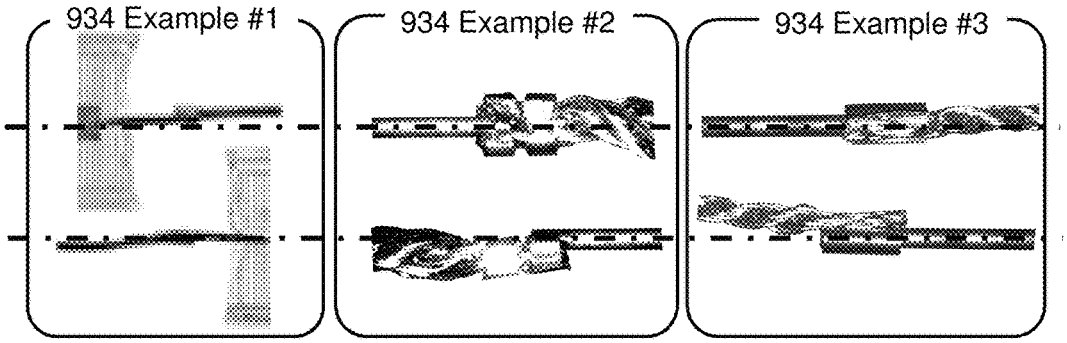

Example: 1000 W DE Hort lamp
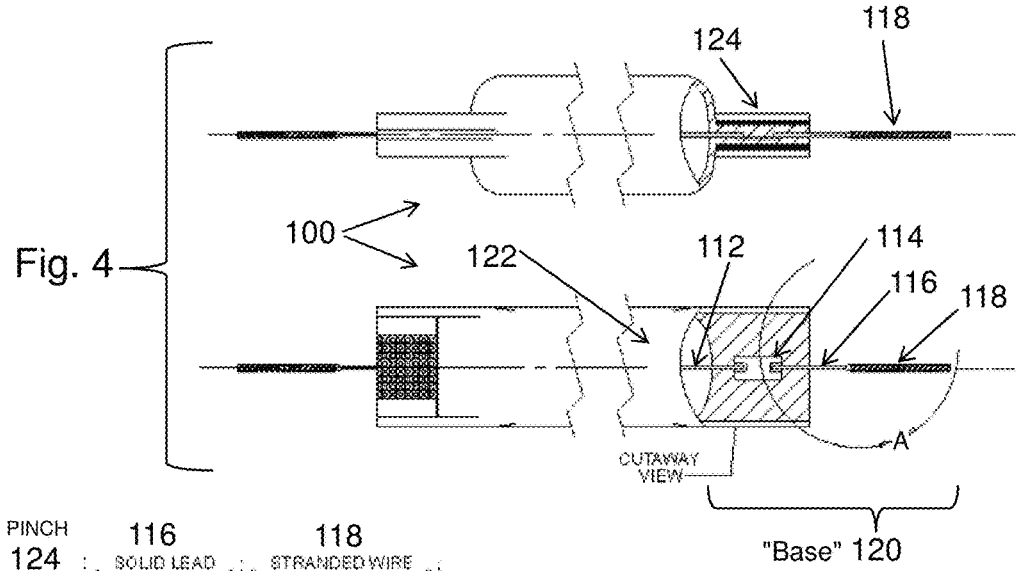
Fig. 4
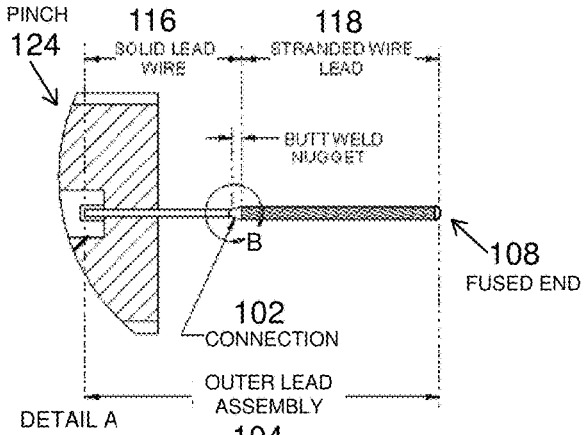
Fig. 4A
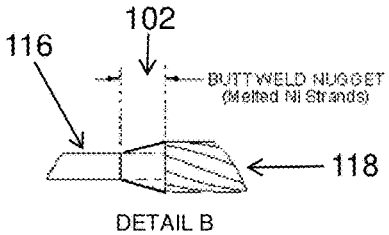
Fig. 4B
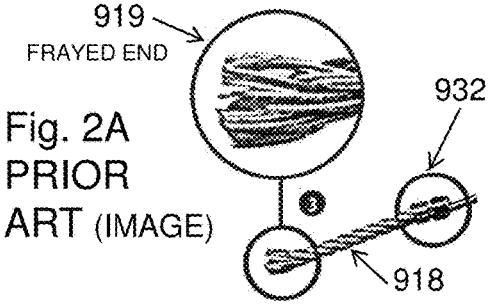
Fig. 2A PRIOR ART (IMAGE)
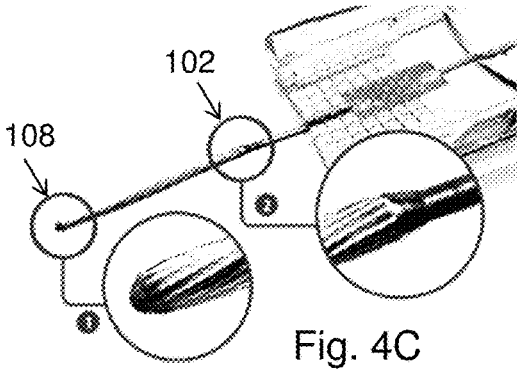
Fig. 4C (IMAGE)

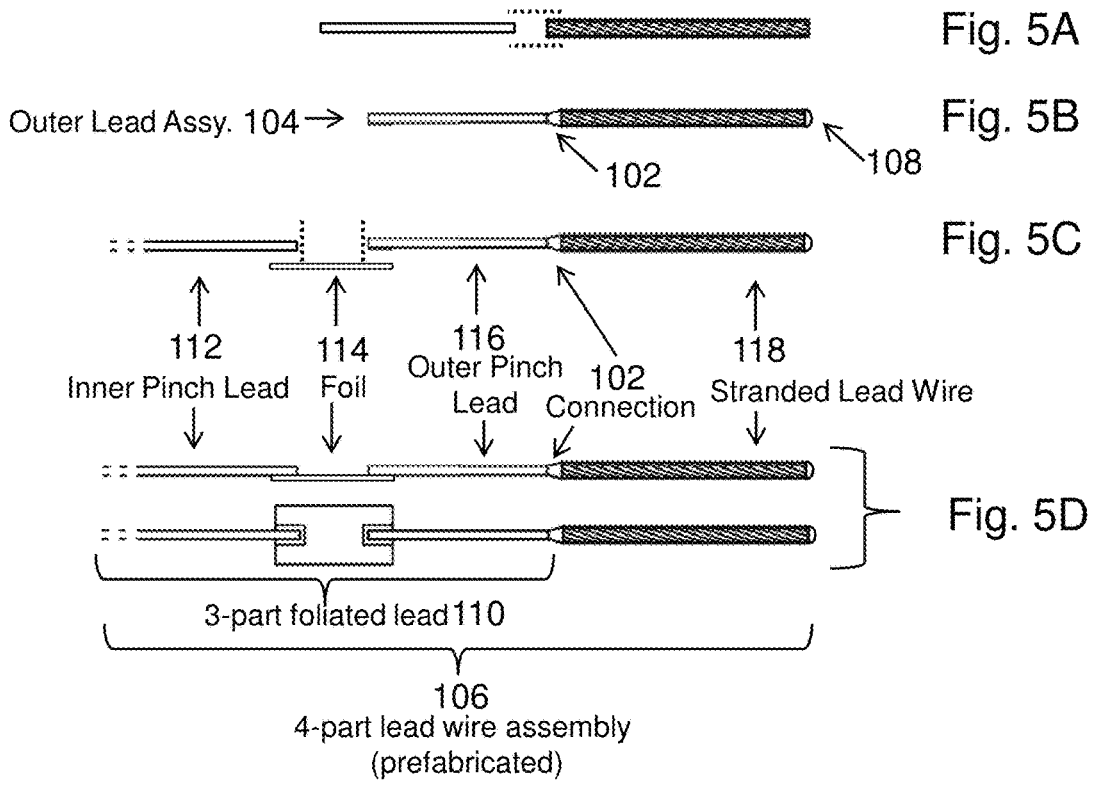
Fig. 6
(IMAGE)
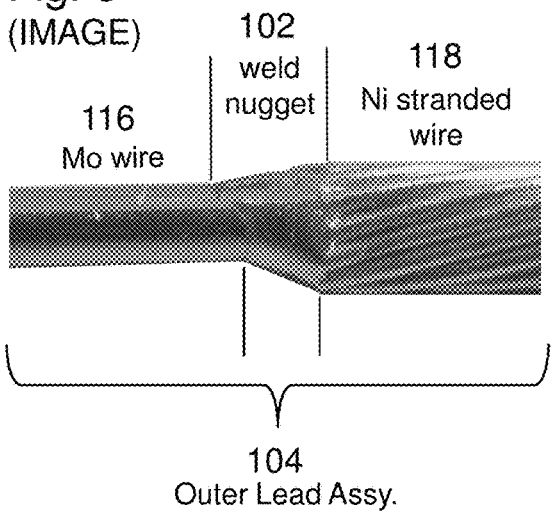

Fig. 7 BENDING TEST

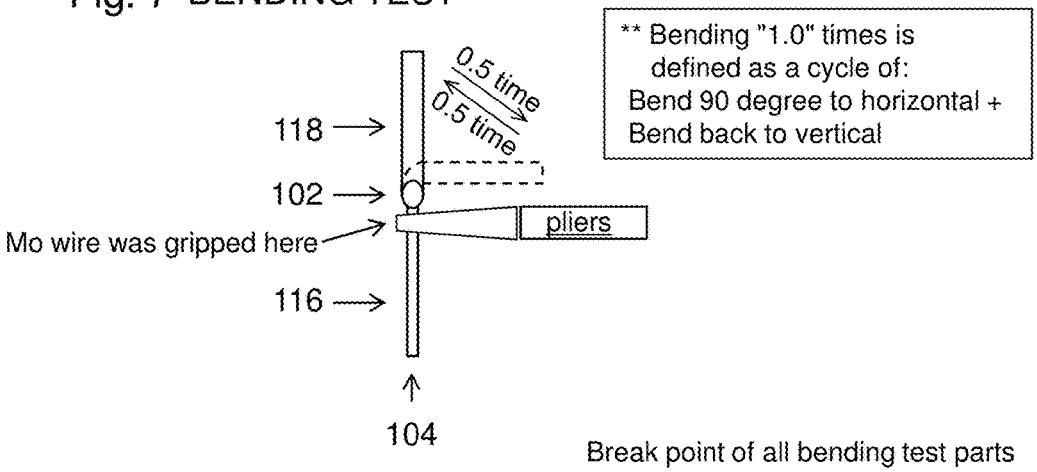

Break point of all bending test parts was the stranded wire near the weld. It was not weld nugget or Mo wire where it was held by pliers.

Fig. 8 TESTING RESULTS

| | Test | # | ELI Butt Weld | Philips Crimp |
|---|---|---|---|---|
| BEFORE Sealing in Quartz | Tension strength (kg) | 1 | >16.8* | |
| | | 2 | >16.8* | |
| | | 3 | >16.8* | |
| | Bending test (# times bent**) | 1 | 26.5 | |
| | | 2 | 35.5 | |
| | | 3 | 25.5 | |
| AFTER Sealing in Quartz | Tension strength (kg) | 1 | >16.8* | 16.4 |
| | | 2 | >16.8* | 14.8 |
| | | 3 | >16.8* | 15.6 |
| | Bending test (# times bent**) | 1 | 27.5 | 19.5 |
| | | 2 | 34.5 | 23.5 |
| | | 3 | 28.0 | 24.5 |

* The wire could not be broken. (exceeded limit value of test machine)

STRANDED OUTER LEAD WIRE ASSEMBLY FOR QUARTZ PINCH SEALS

CROSS-REFERENCE TO RELATED APPLICATIONS

This application claims the benefit of U.S. Provisional Patent Application No. 62/262,768, filed Dec. 3, 2015, said application hereby incorporated in its entirety by reference herein.

TECHNICAL FIELD OF THE INVENTION

The present invention relates to lead-in wire assemblies for use in fused silica pinch seals and, more particularly to connection of an additional wire to the external portion of said assemblies.

BACKGROUND OF THE INVENTION

Referring to prior art examples shown in FIGS. 1-3B, lamps 900 such as a 1000 watt double ended horticultural lamp (1000 W DE), e.g., with a high pressure sodium (HPS) arc tube inside a "quartz" (fused silica) outer jacket, have a special "base" 920 (e.g., designated as a K12×30 s base) that interfaces with a corresponding fixture socket (see FIGS. 3A-3B) in order to hold the lamp in the fixture while also providing electrical connection to the lamp lead wires. The base 920 comprises an outer lead assembly 932 made from a stranded (a.k.a. "braided") Ni wire (may be an alloy such as NiMn) 918 that is mechanically and electrically attached to a refractory metal (e.g., molybdenum (Mo) or Mo alloy) outer pinch lead wire 916 that extends out of a "pinch seal" 924 end of the quartz outer jacket 922 of the lamp 900.

As shown in FIGS. 3A-3B a typical fixture socket for this K12×30 s base 920 has a pair of flat faced contact plates to clamp the outer lead assembly 932 (should be only the stranded wire lead 918 part of the outer lead assembly 932). The socket clamping/contact plates are a fixed longitudinal distance apart, and registered against the pinch seal ends 924 to be a fixed distance away from each pinch 924 (which is why the pinch is considered part of the lamp base 920, along with the outer lead assembly 932). Regarding lamp installation in the fixture/sockets, keep in mind that the lamp 900 is typically pushed upward into an overhead fixture wherein the lamp hangs underneath the sockets. To install a lamp 900, the lamp body is held and used to push the lamp outer lead assemblies 934 into the "bottom" of the space between opened contact plates, holding the pinch seals 924 against stops in the socket, and sliding the sockets until they lock in a closed position where the contact plates are squeezed together to pinch the lead wire to make a mechanical and electrical connection. The contact plates are only located at the "bottom" of the gap, so if a lead assembly 934 is bent away from the bottom when inserted (e.g., by misalignment or by being dragged by some kind of interference), then the clamping plates may only partly contact the lead wire. Given the high current (e.g., 8 amps) supplying the lamp, and high starting voltages, a poor electrical connection can cause arcing and/or overheating leading to serious consequences.

The attachment/connection 932 in the outer lead assembly 934 between two generally round wires is difficult, especially because: they cannot be soldered due to high lamp operating temperature; and a mechanical/compression joint by itself (e.g., using a surrounding sleeve that is crushed around the overlapping ends) is not reliable due to cyclic thermal expansion and contraction of dissimilar metals and further due to surface oxidation developing over time. This connection is even more challenging because the wires are such different metals with different melting points, have different diameters (e.g., 1 mm solid vs. ~1.5 mm twisted bundle), and different amounts of hardness/compressibility (stranded Ni is more easily deformed by compression, while solid Mo is relatively hard and non-compressible). Furthermore, the stranded wire has, for example, 19 strands that are twisted together like a cable, which makes resistance welding very difficult and inconsistent due to variable resistance between strands. Finally, as further detailed below, the connection 934 must be made after lamp sealing, so the outer pinch lead 116 will generally be oxidized so that it must be cleaned before a connection can be made.

The connection method that has been in use in the prior art is a combination of resistance spot welding of various portions of overlapping wire ends and a sleeve that is crimped around one or both of the overlapping wire ends. This prior art connection will be generically referenced herein as a "crimp connection" 932, even though welding is also typically involved. For example, the sleeve may be crimped around both wire ends to hold them together and the spot weld(s) are made simultaneously through all of the overlapping layers, or separately where the sleeve overlaps each wire. Or, for example, the sleeve may not surround the wires so that the spot welds can be made separately between each lead and the sleeve, thereby passing weld current through only one layer of the sleeve material. Before resistance welding, any oxidation must be cleaned off the wire surface(s), for example by brushing or sand blasting. The longitudinal positioning of the sleeved connection 934 is not precise enough to ensure adequate connection unless there is extra overlapping length (i.e., a larger target) in which the connection can be made. Therefor any solid wire 916 extending beyond the sleeve is usually trimmed off in an attempt to avoid potential interference with the socket clamp (see FIG. 1A).

Other techniques and method variations may be employed to establish the prior art electrical-mechanical connection designated herein as a crimp connection 932, however they all produce similar results as shown in FIGS. 2-3 by images of the assembly 934 from three different prior art lamp manufacturers. What the examples show is (a) offset misalignment of the Mo outer pinch lead 916 and the stranded Ni lead 918, (b) a stranded lead that is offset from the lamp axis in different directions ("crankshaft"—compare ends of the lamp in FIG. 2), (c) a stranded lead 918 that is typically not straight and may also extend outward at an angle to the outer pinch lead 916, and (d) an irregularly shaped larger diameter portion (a lump or bump) where the sleeve covers the connection 932. Any of these irregularities can cause serious electrical problems if it interferes with optimum closure of the socket clamps which need to compress and grip a significant length of the stranded lead.

FIGS. 1-3 show typical construction details and example images of prior art implementations of this base 920 in a 1000 W DE HPS horticultural lamp 900 as made and sold by three different lamp making companies. The lamp is a high power HID light source (e.g., HPS) sealed in a tubular quartz outer jacket 922, the quartz material being used to withstand the very high operating temperature imposed on the envelope of a lamp like this, which is a horizontal burning high wattage lamp with a close fitting outer jacket having a gas fill.

Also referring to FIGS. 1-2, for hermetically sealing a quartz envelope 922 around an electrical lead wire 916, a quartz pinch seal 924 is made (e.g., prefabricated) using a 3 part foliated lead assembly 910 wherein the inner pinch lead 912 and outer pinch lead 916 are solid wires (typically round) that are welded to the face of a thin foil 914, all made of refractory metal(s) such as some form of molybdenum (Mo). During the pinch sealing operation the 3 part foliated lead assembly 910 is held in position and the quartz tube end is heated enough for it to be pinched flat into a generally planar shape as shown.

Importantly, in the prior art the stranded wire lead can only be added (to complete the lamp "base") after the pinch seal is completed. This is because the prior art crimp connection 932 between the Mo outer pinch lead and the Ni stranded wire will not survive the extreme heating it would receive during the quartz pinch sealing process (quartz/fused silica "glass" requires the most intense heat of all lampmaking glass materials, e.g., 2,000 C versus around 1500 C for hard glass). As a result of the heating in atmosphere, the outer pinch lead 916 develops an oxide layer that must be removed (e.g., by sand blasting, brushing, etc.) before an acceptable weld connection can be made. Further complicating matters, the heating causes partial recrystallization of the Mo wire, making it somewhat brittle, therefor the crimp connection process must take care to avoid breaking the Mo wire. (The recrystallization may be controlled by using doped moly.)

There are many disadvantages and potential problems with this prior art "crimp connection", including one or more of the following:

- Crimp connection can have a poor (high resistance) electrical connection of Ni to Mo because mixed materials overlapped and wrapped in sleeve do not make a good weld using a resistance welder.
- Crimp connection can cause an insecure hold and/or poor (high resistance) electrical connection between the outer lead and the fixture socket due to irregularly shaped crimp connection, inconsistent location, and non-aligned offset wires. (The socket uses a pair of flat faced contact bars to clamp the Ni stranded wire lead at each end. The socket clamps are a fixed longitudinal distance apart so inaccurate crimp connection location can result in a socket clamping onto the crimp sleeve instead of the Ni stranded wire.)
- Offset or otherwise misaligned outer leads may tilt the lamp off of the optimum axial location in the fixture reflector. Keeping the arc tube (which is mounted on center axis of the lamp) centered is important for the reflector because all DE reflectors are designed to efficiently reflect the light produced by the lamp based on the arc tube being positioned in the center of the reflector, otherwise this will change the optics and efficiency of the reflector, the fixture, and the overall lighting quality.
- Crimp connection is a complicated process that is difficult to automate and is therefor time consuming/expensive.
- Quality control issues include: length of connected outer lead, amount of overlap, location of overlap, non-zero angle between wires, and the like.

BRIEF SUMMARY OF THE INVENTION

According to the invention a stranded outer lead wire assembly for a quartz pinch sealed lamp. The stranded outer lead wire assembly is a butt welded connection of a refractory metal outer pinch lead (e.g., molybdenum solid wire) and a stranded soft metal lead wire (e.g., nickel wire strands twisted together). The assembly is prefabricated and then welded to sealing foil to make a four part foliated lead wire assembly for pinch sealing in the quartz outer jacket. The foliated lead wire assembly and a quartz envelope lamp utilizing the stranded outer lead wire assembly are also claimed. The sealing machine is adapted to protect the stranded outer lead assembly with a water cooled sleeve. In an embodiment, the outer end of the stranded lead is fused to prevent fraying.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different versions of an element 109 which are similar or related in some way but are separately referenced for the purpose of describing modifications to the parent element (109). Such relationships, if any, between similar elements in the same or different figures will become apparent throughout the specification, including, if applicable, in the claims and abstract.

The structure, operation, and advantages of the present preferred embodiment of the invention will become further apparent upon consideration of the following description taken in conjunction with the accompanying drawings, wherein:

FIG. 1 shows a plan view and a side view, with cutaway/cross-section portion indicated by circle "c", of a prior art lamp having a K12×30 s base exemplifying a prior art outer lead with crimp connection.

FIG. 1A shows a magnified view of a base portion of the prior art lamp of FIG. 1.

FIG. 2 is a plan view image of an example #1 of the prior art lamp of FIG. 1.

FIG. 2A is a perspective view image, with magnified outside end portion (frayed), of a prior art stranded lead wire.

FIG. 3 shows images of prior art outer lead assembly portions as implemented in example prior art lamps made and sold by three different lamp making companies.

Figure 3A:
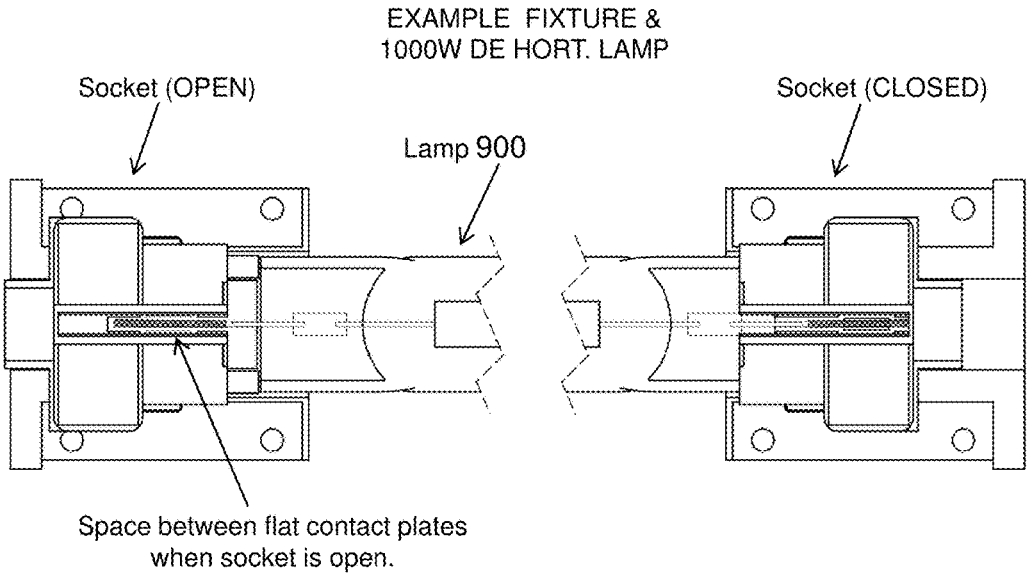
Figure 3B:
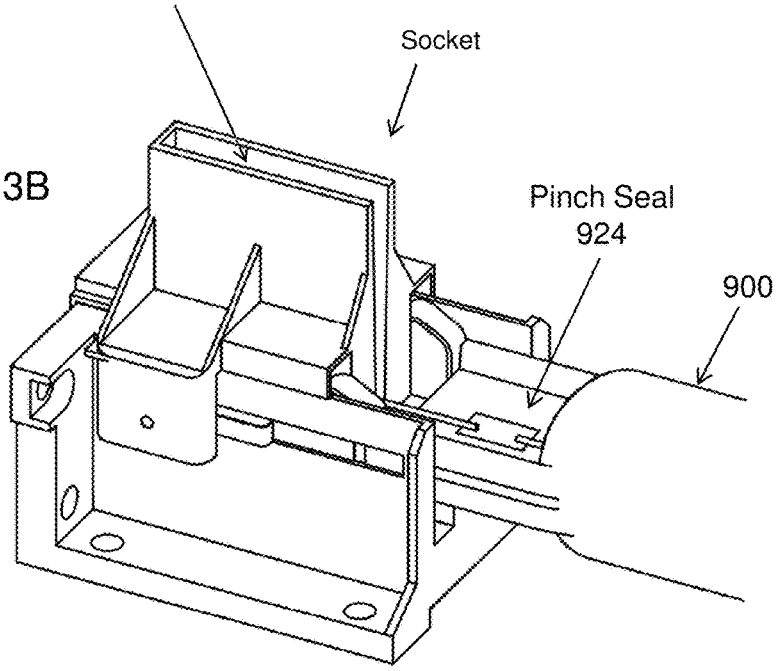

FIGS. 3A and 3B are perspective views of an example prior art fixture having a typical socket for the K12×30 s base, and illustrating a lamp being installed.

FIG. 4 shows a side view and a plan view, with cutaway/cross-section portion indicated by label, of a lamp having a K12×30 s base exemplifying an outer lead with a butt weld connection according to the present invention.

FIG. 4A is a magnified detail view of a portion of FIG. 4 indicated by circle "A".

FIG. 4B is a magnified detail view of a portion of FIG. 4A indicated by circle "B".

FIG. 4C is a perspective view image, with magnified connection and fused end portions, of a base portion of a lamp having an outer lead assembly according to the present invention.

FIGS. 5A-5D are side views of steps in a process for prefabricating an outer lead assembly, a 3-part foliated lead, and a 4-part lead wire assembly, all according to the present invention.

FIG. 6 is a partial side view image of an outer lead assembly according to the present invention.

FIG. 7 is an annotated illustration that describes an outer lead assembly bending test procedure according to the present invention.

FIG. 8 shows tabulated results of lead assembly bending tests using the procedure of FIG. 7 on a prior art assembly (using a crimp connection) compared to an assembly using a butt weld according to the present invention.

DETAILED DESCRIPTION OF THE INVENTION

The following table is a glossary of terms and definitions, particularly listing drawing reference numbers or symbols and associated names of elements (features, aspects) of the invention(s) disclosed herein or of related elements in the prior art.

| REF. | TERMS AND DEFINITIONS |
|---|---|
| | ELEMENTS OF THE INVENTION(S) |
| 100 | lamp using the disclosed butt welded lead wire assembly 106 with quartz outer jacket 122 and a pinch seal 124 (e.g., high wattage, double ended outer jacket, with one lead-in wire at each end) |
| 102 | butt welded connection of outer pinch lead 116 and stranded lead wire 118, butt weld nugget |
| 104 | prefabricated outer lead assembly, 116 and 118 joined by butt weld connection 102, for inclusion in a 4-part lead wire assembly 106; all assembled before sealing in quartz pinch |
| 106 | prefabricated 4-part lead wire assembly for sealing in a quartz pinch seal |
| 108 | fused end of stranded lead 118 (e.g., TIG welded) |
| 110 | 3-part foliated lead portion of prefabricated 4-part assembly 106 (inner 112 and outer 116 pinch leads welded to foil 114) |
| 112 | inner pinch lead |
| 114 | quartz pinch sealing foil |
| 116 | outer pinch lead |
| 118 | stranded lead wire |
| 120 | "Base" portion of the pinch sealed lamp 100 that includes a stranded lead wire 118 that is connected 102 to the outer pinch lead 116 |
| 122 | quartz outer jacket of lamp |
| 124 | quartz pinch seal (e.g., double ended with one lead-in wire assembly) |
| | ELEMENTS OF THE PRIOR ART, ILLUSTRATED FOR COMPARISON AND CONTRAST WITH ELEMENTS OF THE DISCLOSED IMPROVED LAMP |
| 900 | prior art lamp with quartz outer jacket 922 and a pinch seal 924 (e.g., high wattage, double ended outer jacket, with one lead-in wire at each end) |
| 910 | preassembled 3-part foliated lead for sealing in a quartz pinch seal 924, a.k.a. lead-in wire assembly (for outer jacket) |
| 912 | inner pinch lead |
| 914 | quartz pinch sealing foil |
| 916 | outer pinch lead |
| 918 | stranded lead wire |
| 919 | outside end of stranded lead 918 (showing fraying) |

-continued

| REF. | TERMS AND DEFINITIONS |
|---|---|
| 920 | "Base" portion of the pinch sealed lamp 900 that includes a stranded lead wire 918 that is mechanically (e.g., crimp) connected 930 to the outer pinch lead 916 |
| 922 | quartz outer jacket of lamp |
| 924 | quartz pinch seal (e.g., double ended with one lead-in wire assembly) |
| 932 | mechanical (and electrical) connection of stranded lead wire 918 to the outer pinch lead 916, typically includes a crimped-on sleeve plus resistance weld of overlapping ends of the wires 916, 918 |
| 934 | prior art outer lead assembly = 916 and 918 joined by crimp connection 932 |

The invention(s) will now be described with reference to the drawings using the reference numbers and symbols listed in the above table.

A significant part of the present inventive concept is to replace the crimp connection 932 with a butt weld connection 102 as illustrated in FIGS. 4-6 The butt weld connection provides many advantages over the crimp connection. For example, it allows consistently optimum clamping in the socket because the butt weld nugget 102 has a relatively uniform shape without any protruding bumps and is always at a fixed distance from the pinch seal end 124, as determined by the length of the outer pinch lead 116. Also, the connected conductors are coaxially aligned, thus always placing the full length of the outermost lead (stranded lead 118) in the center of the socket clamps, thereby also accurately positioning the lamp 100 (and arc tube) at the focal line of the fixture reflector.

In addition to the greatly improved shape, as shown particularly in FIG. 4B and more generally in FIGS. 4A-6, the weld nugget is formed by a butt welding operation that melts an end portion of the Ni strands 118 such that the molten metal flows around a length of the Mo wire end 116 to form a low electrical resistance, mechanically strong connection more like a braze or arc weld connection. The contact area between the two wires is much larger than for a spot weld even one with a crimped sleeve (e.g., prior art connection 932), and furthermore the contact area is substantially sealed against subsequent oxidation.

An added advantage of the butt weld is that it is made before lamp sealing, for example by prefabricating an outer lead wire assembly 104 (stranded Ni leadwire 118 plus solid wire (e.g., Mo) outer pinch lead 116) as shown in the step of FIG. 5A to 5B. This may be done on automated welding equipment before the outer pinch lead 116 is welded to the foil 114 as in making a 3 part foliated lead 110 (step of FIG. 5C to 5D). In other words, a 4 part lead wire assembly 106 is made (prefabricated) before the pinch seal 124 is formed on it. Previously, only the 3-part foliated lead 110 was prefabricated. In a preferred embodiment, the 4 part lead wire assembly 106 is a prefabricated assembly of the inner pinch lead 112, the sealing foil 114, and the outer lead assembly 104, which can be done on a 3 part lead making machine that is adapted to hold the assembly 104 such that the outer pinch lead wire 116 part of the assembly 104 can be welded to the foil 114 as before. The outer lead assembly 104 is made on a separate butt welding machine, for example one that feeds both the wire 116 and the lead 118 off of reels/spools, pushes the ends together while welding heat is applied, pauses to solidify, and then cuts both outer ends to desired length. (This description may omit other details that are known to be included, e.g., an interface material between the foil and the lead wires welded to it.)

An additional feature of the outer lead assembly 104 prefabrication is to create a fused end 108 (see FIGS. 4A, 4C and 5B) on the stranded lead 118 outer end to prevent a frayed end (see prior art example frayed end 919 shown in FIG. 2A). This may be done using a TIG welder.

Prefabricating the entire (4-part) lead wire assembly 106 (using a butt welded connection 102) is much easier to do than the prior art crimp connection 930 because all of the (weld) connections can be made on a dedicated purpose machine in a controlled environment on a convenient schedule without having to hold a bulky sealed lamp 100 that may get in the way of the crimp and welding equipment. This is easier to automate thereby avoiding manual operations, and thereby reducing cost.

The butt weld equipment and process described here is an adaptation of a process previously used to make a butt weld connection between stranded Ni wire and a round solid tungsten lead wire (not Mo). The prior art lead wire assembly is distinguished by the use of round tungsten wire because it is for sealing in a hard glass stem. Tungsten has a thermal expansion coefficient that is suitable for such seals in "hard glass" so it is used without foil. It is important to note that hard glass sealing is accomplished at much lower temperatures (1500-1600 C) than for quartz glass sealing (approximately 2000 C), therefor the butt weld has never been previously suggested for use with quartz sealing lead wires. It was not obvious to try butt weld connected stranded nickel outer lead wire for quartz pinch seal leads because the general assumption has been that the nickel part of the butt weld would (obviously) soften/melt to fall apart, and/or would become too brittle as a result of the extreme heat of quartz pinch sealing being sufficient to affect the wire microstructure.

Thus the herein disclosed butt welded quartz pinch outer leadwire assembly 104, and the associated lampmaking process/method, is novel in that it is used as a lead wire for a quartz jacket 122 lamp 100 with a quartz pinch seal 124 that exposes the butt weld 102 and the stranded nickel lead wire 118 to much higher temperatures for a longer duration compared to hard glass sealing. Therefor it was not obvious that this would work, and experimentation and testing was needed to address the concerns about weld integrity after quartz pinch sealing. In particular, the quartz pinch operation has been adapted to protect the butt welded outer lead assembly 104 during sealing. Whereas the previous operation did not protect the exposed outer pinch lead 916, our inventive modifications to the pinch sealing machine add a water cooled sleeve that protectively encloses the assembly 104, i.e., the stranded lead 118, the weld connection 102 and an external portion of the outer pinch lead wire 116.

It may be noted that in our lamps, the wire we have labeled as "Mo" (molybdenum, a.k.a. "moly"), especially the outer pinch lead 116 is preferably lanthanated molybdenum ("ML wire"), which is Mo doped with lanthanum oxide LaO3 to increase its recrystallization temperature. (to preserve adequate ductility after being subjected to the extreme heating of the quartz pinch sealing process (~2000 C). There are other doping agents for refractory metals known to have similar benefits, so the present disclosure is not specifically limited to lanthanated moly outer pinch lead 116, however that is a preferred (best known mode) embodiment of the outer pinch lead 116 that is butt welded to the stranded Ni lead wire 118. This is the material that we have tested so far and we know it works in terms of making an adequately flexible, non brittle outer leadwire assembly 104. We started with the ML wire because we have had a positive experience with its use for at least the sealing foil part of foliated leads in quartz pinch seals.

Prior art butt welded stranded Ni lead wire assemblies were designed to be sealed in hard glass which requires tungsten wire in order to seal properly (instead of foil or dumet). Recrystallization embrittlement is not as much a problem for this because hard glass only needs to be heated to about 1500-1600 C during its sealing process.

Regarding concerns about the effects of quartz pinch sealing temperature, we examined the structure and microstructure of the weld nugget before and after sealing with our adapted sealing machine. FIGS. 4C and 6 are magnified views of photos taken after sealing What we see leads to the following conclusions:

a) that the "weld nugget" 102 is a tapered volume of melted Ni wire strands that flowed and fused over the unmelted end of the Mo wire.

b) that the weld structure is substantially unchanged by the heat from sealing the Mo wire in the quartz pinch. (This is helped by our use of lanthanated moly wire ("ML") which resists and minimizes recrystallization embrittlement.)

In FIGS. 7-8 our bending test is described and results tabulated. The bending test was performed to determine if the assembly 104 was unacceptably embrittled by the quartz pinch sealing process. For comparison, the bending test was also conducted on a prior art crimp connection (as found in Phillips lamp samples). Unexpectedly, our butt weld connection showed no significant difference in the test results before vs. after pinch sealing. On the other hand, the crimp connections were significantly more brittle than our butt weld connections.

Tensile tests were also conducted to determine if weld strength was affected. Since our butt weld tensile strength exceeded the ability of our test machine to measure it, we cannot determine differences, if any, before versus after sealing, however the tester did show that our butt weld connection was significantly stronger than the prior art crimp connection.

We concluded that our butt weld connection is better than the prior art connection in every way.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims. Undoubtedly, other "variations" based on the teachings set forth herein will occur to one having ordinary skill in the art to which the present invention most nearly pertains, and such variations are intended to be within the scope of the present disclosure and of any claims to invention supported by said disclosure.

What is claimed is:

1. A quartz envelope lamp with a stranded outer lead wire comprising:

an outer lead wire assembly comprising a butt welded connection of a molybdenum solid wire outer sealing lead to a stranded outer lead wire;

a sealing foil welded to the outer lead wire assembly; and a hermetic quartz seal formed around the sealing foil.

2. The quartz envelope lamp of claim 1 wherein:

the hermetic quartz seal is a pinch seal.

3. The quartz envelope lamp of claim 1 wherein:
the stranded outer lead wire comprises nickel wire strands twisted together.

4. The quartz envelope lamp of claim 1 wherein:
the molybdenum wire is doped to minimize recrystallization embrittlement.

5. The quartz envelope lamp of claim 1 wherein:
the molybdenum wire is doped with lanthanum oxide LaO3.

6. The quartz envelope lamp of claim 1 wherein:
the stranded outer lead wire and the solid molybdenum wire are approximately coaxially aligned in the butt weld; and
the butt weld comprises melted nickel wire strands that fused over the end of the solid molybdenum wire.

7. A lead wire for hermetically sealing in a quartz envelope lamp comprising:
a stranded outer lead wire butt welded to a molybdenum solid wire outer sealing lead; and
the outer sealing lead welded to a molybdenum sealing foil.

8. The lead wire of claim 7, further comprising:
an inner sealing lead welded to an inner end of the sealing foil.

9. The lead wire of claim 7, wherein:
the stranded outer lead wire comprises nickel wire strands; and
the strands are fused together at an outer end thereof.

10. The lead wire of claim 7, wherein:
the molybdenum wire is doped to minimize recrystallization embrittlement.

11. The lead wire of claim 7, wherein:
the molybdenum wire is doped with lanthanum oxide LaO3.

12. The lead wire of claim 7, wherein
the stranded outer lead wire and the solid molybdenum wire are substantially coaxially aligned in the butt weld; and
the butt weld comprises melted nickel wire strands that fused over the end of the solid molybdenum wire.

13. A method of manufacturing a quartz envelope lamp with a stranded outer lead wire, comprising the steps of:
forming a stranded outer lead wire assembly by butt welding an inner end of a stranded lead wire to an outer end of a molybdenum solid wire outer sealing lead;
welding the molybdenum outer sealing lead to an outer end of a sealing foil;
welding an inner sealing lead to an inner end of the sealing foil; and
hermetically sealing the quartz envelope around the sealing foil.

14. The method of claim 13 wherein:
the step of forming the stranded outer lead wire assembly is performed before the step of welding the molybdenum outer sealing lead to an outer end of a sealing foil.

15. The method of claim 13 wherein the step of forming the stranded outer lead wire assembly further comprises:
approximately coaxially aligning the stranded outer lead wire and the solid molybdenum wire while butt welding; and
applying heat sufficient to melt nickel wire strands to fuse over the end of the solid molybdenum wire.

16. The method of claim 13 further comprising the step of:
using a sleeve to protect the stranded outer lead wire assembly during the step of sealing the quartz envelope.

17. The method of claim 16, wherein:
the sleeve is cooled by flowing liquid or gas coolant.

18. The method of claim 13 further comprising:
using a quartz pinch sealing method.

19. The method of claim 13 further comprising:
using lanthanated molybdenum wire.

* * * * *